US005123221A

United States Patent [19]

Legault

[11] Patent Number: 5,123,221

[45] Date of Patent: Jun. 23, 1992

[54] MODULAR WALL STRUCTURE AND UNITS THEREFOR

[76] Inventor: Gilbert Legault, 51 Main Street, Box 120, Markstay, Ontario, Canada, P0M 2G0

[21] Appl. No.: 386,599

[22] Filed: Jul. 31, 1989

[51] Int. Cl.[5] ..... E02D 27/00; E04B 1/00

[52] U.S. Cl. ..... 52/293; 52/284; 52/604; 52/608; 256/19; 405/284; 405/286

[58] Field of Search ..... 52/233, 284, 561, 564, 52/566, 604, 605, 606, 607, 608, 612, 503, 504, 293, 311, DIG. 9; 405/284, 286; 446/85, 124; 256/19

[56] References Cited

U.S. PATENT DOCUMENTS

| | | | |
|---|---|---|---|
| 729,918 | 6/1903 | Braun | 52/284 X |
| 836,017 | 11/1906 | Douglass | 52/607 |
| 900,753 | 10/1908 | Mahler | 52/605 |
| 915,195 | 3/1909 | Lemb | 52/564 |
| 1,465,653 | 8/1923 | Olander | 52/DIG. 9 X |
| 1,817,421 | 8/1931 | Saito | 52/606 X |
| 2,184,682 | 11/1939 | Sentrop | 52/566 |
| 2,745,276 | 5/1956 | Kuhlman | 52/606 |
| 3,878,661 | 4/1975 | Moore | 52/DIG. 9 X |
| 4,068,429 | 1/1978 | Moore | 52/DIG. 9 X |
| 4,473,607 | 9/1984 | Mannella | 52/605 X |

FOREIGN PATENT DOCUMENTS

| | | | |
|---|---|---|---|
| 0427214 | 11/1947 | Italy | 52/606 |
| 0431077 | 2/1948 | Italy | 52/608 |
| 0244632 | 12/1925 | United Kingdom | 52/566 |
| 1238975 | 7/1971 | United Kingdom | 446/124 |

*Primary Examiner*—David A. Scherbel
*Assistant Examiner*—Robert Canfield
*Attorney, Agent, or Firm*—Michael M. Sakovich

[57] ABSTRACT

Blocks cast from concrete into various shapes that include interlocking mortise and tenon corner blocks, cylindrical blocks stackable on a foundation course of base blocks formed with semi-cylindrical channels in which the cylindrical blocks fit, semi-cylindrical blocks and interlocking edging blocks of various forms function as basic modules from which retaining walls and the like may be assembled in the absence of mortar, building forms or poured concrete.

24 Claims, 9 Drawing Sheets

MODULAR WALL STRUCTURE AND UNITS THEREFOR

FIELD OF THE INVENTION

This invention relates to a modular wall structure and more particularly to a wall fabricated from interdependent stackable modules.

BACKGROUND OF THE INVENTION

Modular walls fabricated from cast concrete blocks of various configurations are commonly used in retaining walls and revetment structures. An example of the former is described in U.S. Pat. No. 2,653,450 Fort, which discloses a modular retaining wall comprising a plurality of vertically stacked hollow, cylindrical blocks. The blocks are formed with slotted ends that engage corresponding slotted ends of adjacent blocks to form an interlocked retaining wall. A concrete footing having a sloping wall supporting surface with an upstanding flange disposed along the high side, permits tilting the retaining wall to minimize lateral displacement thereof from side pressures exerted by retained earthworks and the like. Assistance in this respect is also provided by the outstanding flange.

A concrete revetment wall structure is shown in U.S. Pat. No. 3,375,667 Hard, which discloses two embodiments of crinkle bars useful in building walls without mortar. These bars may be either circular or hexagonal in cross-section and are provided with a regular undulating surface that facilitates interlocking of the bars when stacked.

Another form of interlocking, hollow concrete wall modules is disclosed in U.S. Pat. No. 4,172,680 Brown wherein such modules are used to construct an armouring layer over a breakwater. Each module is cast from concrete in the form of a short, hollow cylinder having outer walls that are hexagonal in cross-section. The armouring layer comprises a single layer of upstanding modules arranged in intimate facial contact with adjacent modules being held together by means of gripping clamps or joining strips disposed in corresponding slots formed int he sidewalls of the modules.

Although the prior art, as typified by the foregoing patents, discloses wall construction modules in the form of cast concrete blocks in cylindrical and other configurations which are in themselves well suited to wall construction, the employment of such modules requires special preparation that is expensive, time-consuming, and is beyond the grasp and capability of a non-skilled person. For example, if the teachings of Fort were followed to construct a small garden retaining wall a trench would have to be dug in which concrete would be poured to form a wall supporting footing having a uniformly sloping upper surface. Undertaking the construction of such a footing requires considerable knowledge, practical experience and expensive wooden forms, none of which are likely to be in possession of the average home-handyman.

Although a simple wall may be built without employing footings as implied by Hard, the absence of constraining means to hold together the ends of a short wall would likely result in an unstable wall structure. Moreover, should the building constraining means be undertaken, which is outside the teachings of Hard, skill, special tools and materials would be required in a manner similar to that expected in the application of the Fort disclosure.

It is apparent that although it is well known to use cylindrical concrete blocks, and other blocks in various forms, to construct walls, the application of such knowledge is wanting in the respective areas of foundations that are simple and easy to install, wall constrainst that are likewise simple to construct and finishing appointments that permit flexibility in wall design, construction and appearance.

SUMMARY OF THE INVENTION

A principal provision of the present invention is a modular wall structure that may be assembled using prefabricated and cured concrete blocks having predetermined configurations.

Another provision of the invention is a modular wall that may be assembled without the use of mortar, special framing or forms and poured concrete.

Yet another provision of the invention is a modular wall that is simple in design and is easily assembled.

Still another provision of the invention is a modular wall that may be readily disassembled or rearranged as required to accommodate varying features in terrain.

The problems associated with the prior art may be substantially overcome and the foregoing objectives achieved by recourse to the present invention which relates to a modular wall that includes a combination of interdependent modules arranged in stacked multiple courses. The wall comprises a foundation course comprising a plurality of base blocks disposed in serial contacting relation, individual ones of the blocks including a flat base, upstanding ends, front and back sides and a top surface in which is formed at least one semi-cylindrical channel positioned transversely of the front and back sides. Additionally, the wall includes a first course comprising a plurality of cylindrical wall blocks, individual ones of which engageably fit corresponding ones of the channels in the base blocks.

BRIEF DESCRIPTION OF THE DRAWINGS

The invention will now be more particularly described with reference to embodiments thereof shown, by way of example, in the accompanying drawings in which.

DESCRIPTION OF THE PREFERRED EMBODIMENTS

Various embodiments of the invention hereinbelow described include certain modules that are common to all embodiments. Like numbers are therefore used to identify like elements in all of the embodiments illustrated and described.

Some of the embodiments to which reference will be made hereinbelow include the common structures as noted above and also include modules which are unique to that particular embodiment. It is apparent, therefore, that the best mode contemplated to give effect to the invention is not necessarily confined to any one embodiment but to the particular embodiment best suited to a given set of environmental conditions.

Figure 1:
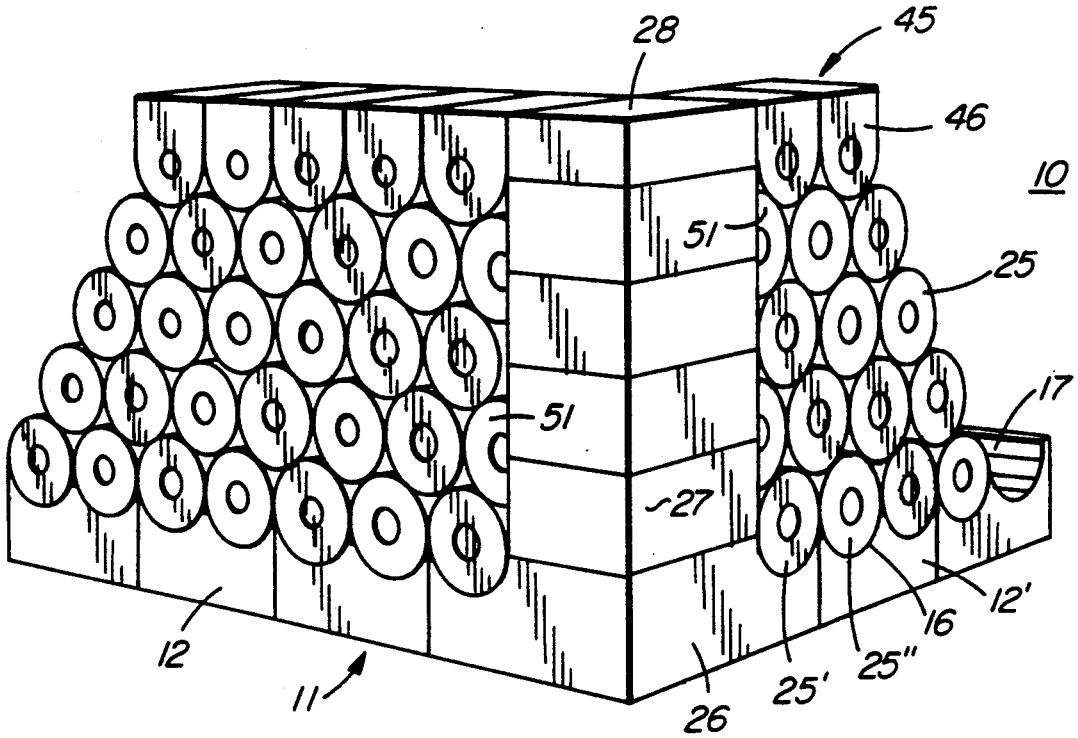
FIG. 1 is a perspective view of one embodiment of a modular wall in accordance with the present invention.

In accordance with an arbitrarily chosen set of numerical designations for the various embodiments to be disclosed herein, FIG. 1 is a perspective view of one embodiment of a modular wall 10 which includes a combination of interdependent modules arranged in stacked multiple courses. Thus, a foundation course 11 includes a plurality of base blocks 12 which are disposed in serial contacting relation, one with the other.

Figure 9:
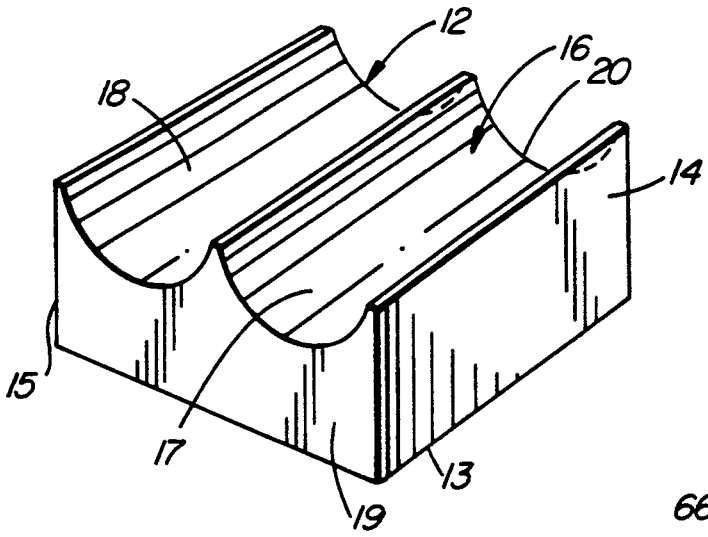
FIG. 9 is a perspective view of a base block shown in the embodiments of FIGS. 1, 3 and 4.

As may be best seen in FIG. 9, a block 12 includes a flat base 13 that requires only a correspondingly flat surface upon which to rest and support the wall 10. Upstanding ends 14 and 15 are engaged in the aforementioned serial contacting relation between adjacent blocks 12. A top surface 16 is seen to be formed into semi-cylindrical channels 17 and 18, respectively, which are positioned transversely between a front side 19 and a corresponding back side 20.

Referring again to FIG. 1, it will be observed that a first wall course comprises a plurality of right-circular cylindrical wall blocks 25 which are configured to engageably fit the channels 17 and 18 of the blocks 12. A perspective view of the block 25 may be seen in FIG. 5 wherein it will be understood that the block is cast from a structural mix of portland concrete cement as are all blocks in the wall 10.

Referring again to FIG. 1, it will be understood that the illustration therein is representative only of an incomplete wall having a square corner and as such is confined to the immediate vicinity of a corner base block 26, upon which is stacked in registry a column of corner blocks 27 surmounted by a corner cap block 28.

Figure 2:
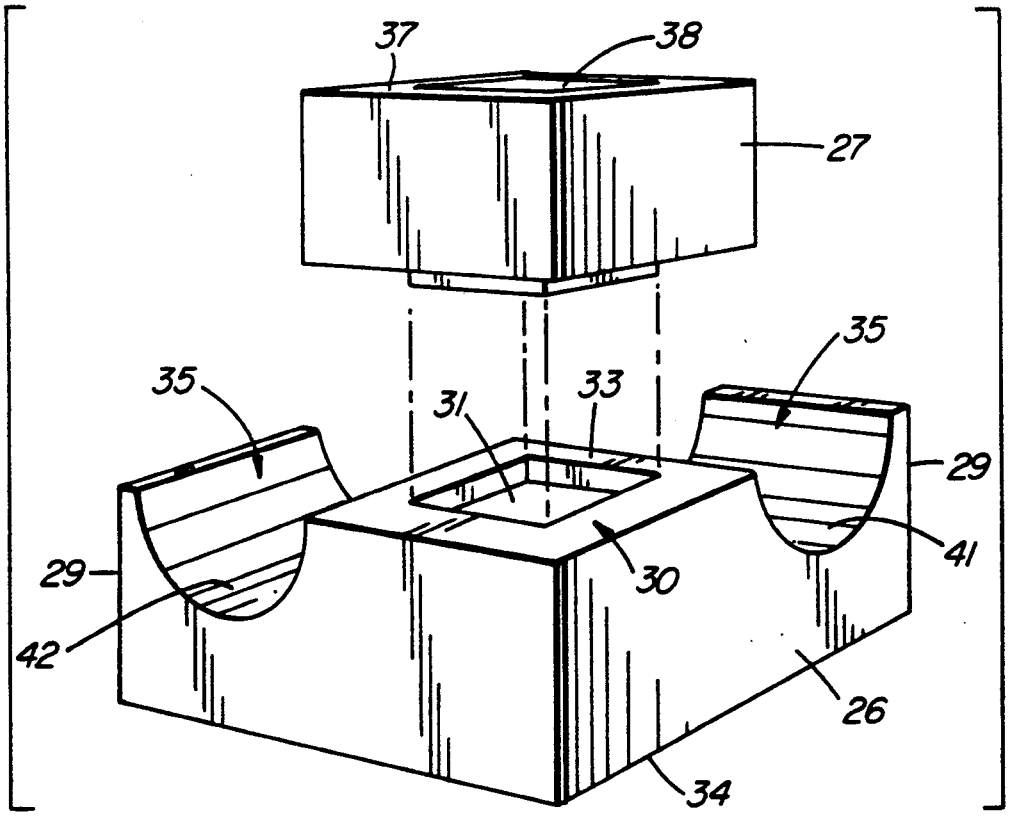
FIG. 2 is a perspective view of a portion of a corner in the embodiment of FIG. 1.

FIG. 2 illustrates, in exploded form, the relative mounting positions of the blocks 26 and 27 and the means by which an interlocking fit therebetween is obtained. In this respect it will be observed that block 26 comprises a flat base 34, and upstanding sides 29. It will be observed also that a top 30 includes a mortise 31 which is adapted to lockably engage a corresponding tenon 32 of the adjacent block 27.

One portion of the top 30 is in the form of a rectilinear annulus 33 which enters into facial contact with a corresponding surface circumscribing the tenon 32 when the block 27 is placed into interlocking relation with the block 26.

Two additional surface portions of the top 30 include a first top surface portion 35 which extends outwardly of the block 27 in longitudinal alignment with the blocks 12 as may be seen in FIG. 1. A significant feature of this surface portion is the inclusion of a semi-cylindrical channel 41 therein which is lockably engageable with one of the blocks 25. Referring again to FIG. 1, it will be seen that the block 25' is retained in contacting relation with an adjacent block 25" that is frictionally fitted in a like channel 16 of an adjoining block 12'.

The second portion of surface 35 corresponds to the first portion, includes a semi-cylindrical channel 42 and is disposed in orthogonal relation with the first portion in a common ground plane.

The block 27 of FIG. 2 will be understood to include a rectilinear annulus that corresponds to the aforenoted annulus 33 together with the tenon 32. Additionally, the block 27 comprises upstanding sides 36 which circumscribe a top surface 37 in which is centrally formed a mortise 38.

Figure 14:
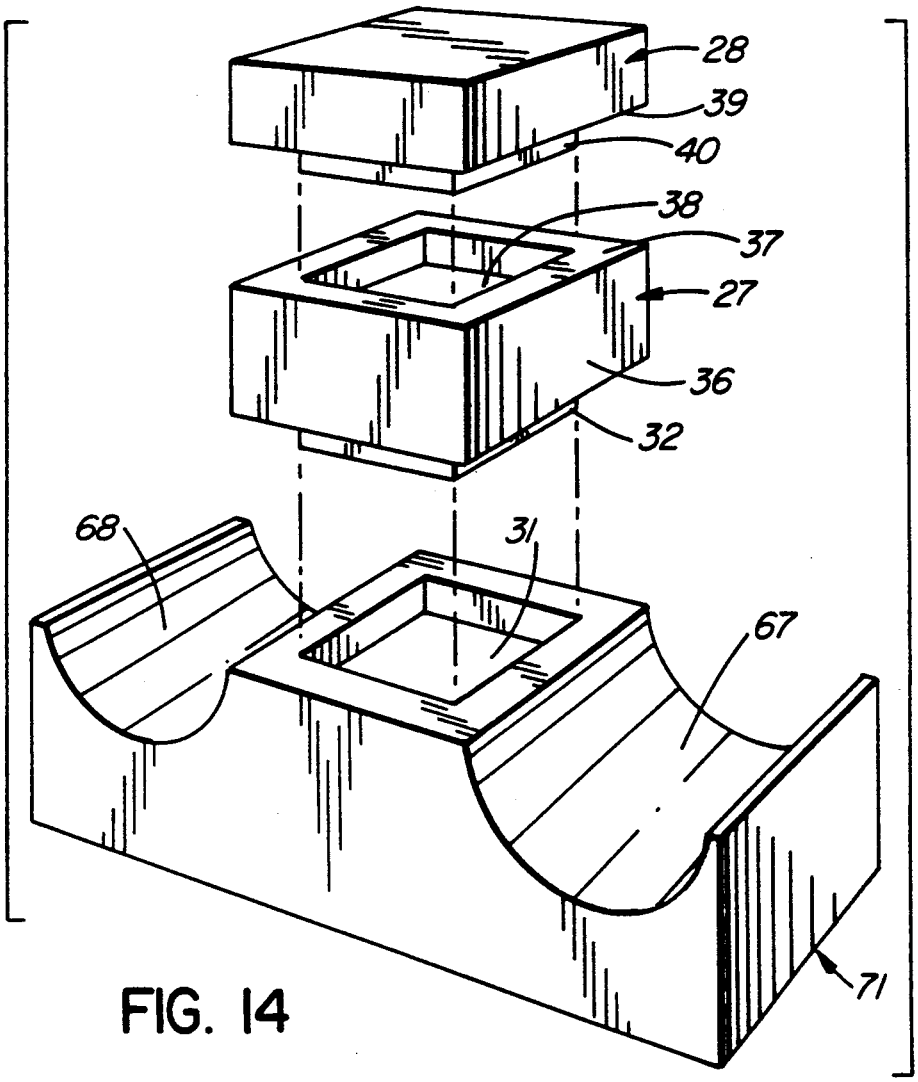
FIG. 14 is a perspective view of a further base block in a pre-assembly configuration with a corner block and a corner cap block.

The block 28 of FIG. 1 is shown separated from its supporting block 27 in FIG. 14 wherein it will be noted that a base 39 of the block 28 has a tenon 40 which is adapted to fit the mortise 38. Reference to FIG. 1 shows the complete corner comprising four blocks 27 together with the block 28 positioned in registry with the block 26.

Three additional wall courses of blocks 25 are shown on adjacent sides of the corner which serves as constraining means disposed at a juncture of the two rows of blocks 12 which are orthogonally positioned in the ground plane.

Placed in stacked relation with the first wall course of blocks 25, three additional courses of blocks 25 together with an edging course 45 are arranged in stacked relation as shown to form a level top surface. This stacked relation shows the blocks 25 as being positioned in mutually contacting relation between corresponding adjacent pairs of wall blocks in an adjoining course. The aforenoted contacting relation also includes edge blocks 46 of the course 45.

Figure 6:
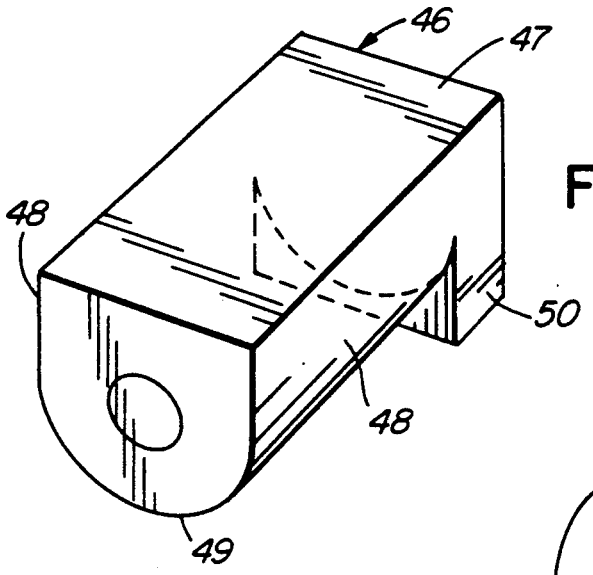
FIG. 6 is a perspective view of an edge block shown in the embodiments of FIGS. 1 and 4.
Figure 7:
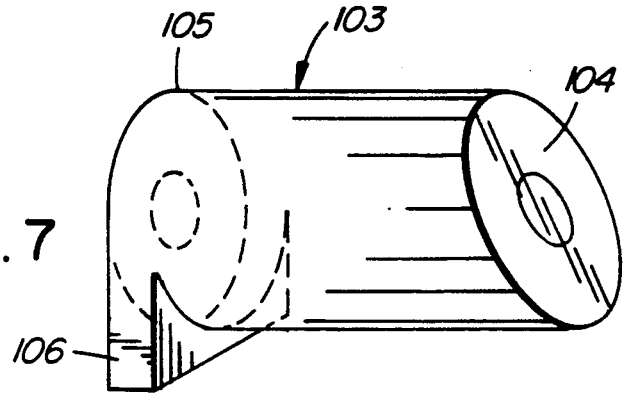
FIG. 7 is a perspective view of a cylindrical wall block having a right-circular end and a frustum end.

Turning next to FIG. 6, it will be observed that the block 46 comprises a top surface 47 which, although not characterized in the drawings, is readily adapted to have a predetermined finish as for example a rough surface to avoid slipping when walking thereon. Upstanding ends 48 mutually contact like ends in adjacent blocks of the course 45 whilst a semi-cylindrical bottom surface 49 mutually contacts corresponding adjacent pairs of the blocks 25 in the fourth course of such blocks as illustrated in FIG. 1. Although not illustrated in FIG. 1, it will be seen in FIG. 6 that the surface 49 further comprises a depending step 50 that is useful in engaging an end surface portion of each one of the corresponding adjacent pairs of blocks 25 for locking the blocks 46 to the fourth course of blocks 25 in FIG. 1. By means of this expedient, the blocks 46 tend to stay in aligned position with the blocks 25 when subjected to normal movement and scuffing encountered in usual vehicular and pedestrian traffic.

Figure 23:
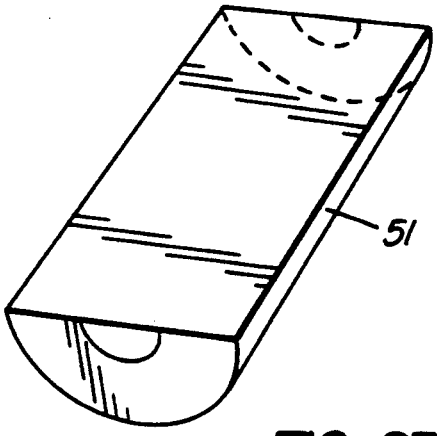
FIG. 23 is a perspective view of a semi-cylindrical block shown in the embodiment of FIG. 20.

In the second and fourth courses of the blocks 25, it will be observed in FIG. 1 that each such course originates at the column of blocks 27 using a semi-cylindrical block 51 as best seen in FIG. 23. The block 51 corresponds in length to the blocks 25 in the same course and functions to fill the space between the blocks 27 and the blocks 25 in the second and fourth courses and also shares in uniformly distributing the overall wall 10 load.

Figure 5A:
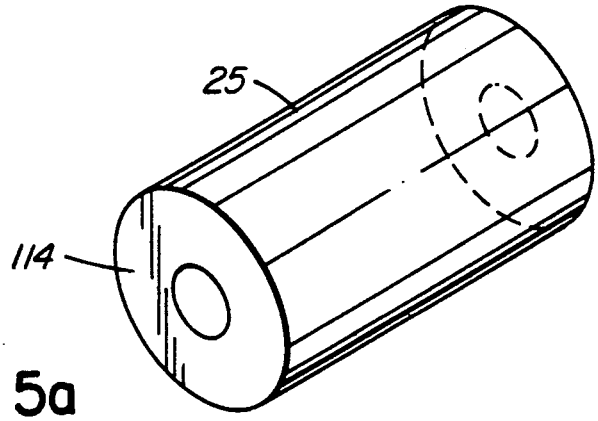
FIGS. 5*a*, 5*b*, 5*c* and 5*d* are persepective views of wall blocks usable in the various wall embodiments of the present invention.
Figure 5B:
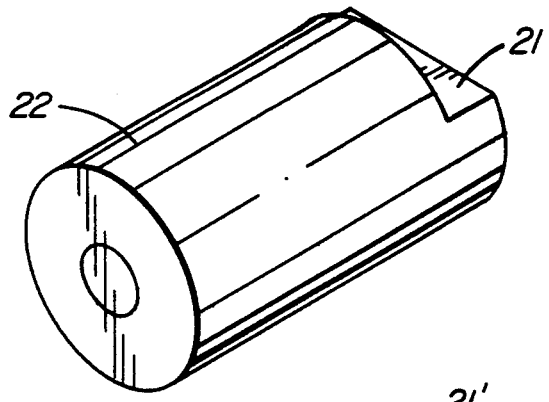
Figure 5C:
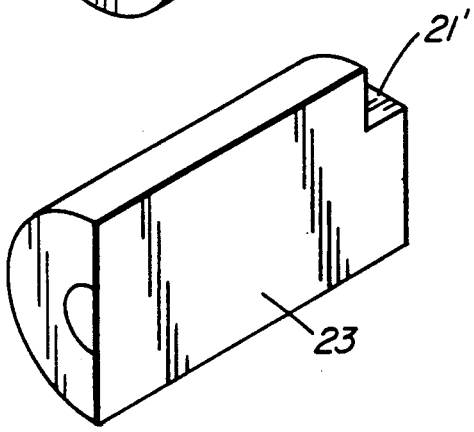
Figure 5D:
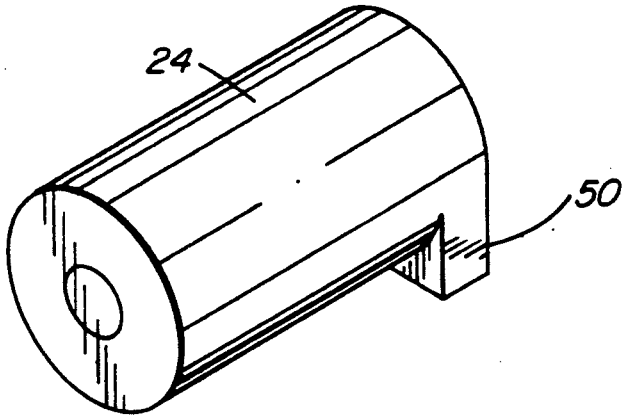

Although not specifically illustrated in FIG. 1, it will be understood that the blocks 25 (FIG. 5*a*) in the fourth course will be shorter in length than corresponding blocks 25 in the other courses. The purpose of this length differential is twofold; to permit alignment of the blocks 46 in the course 45 with the block 28 and to keep all of the outside wall surfaces of respective blocks in a single vertical plane for an improved appearance. Inside wall 10 surfaces would be irregular because of the shorter blocks 25 in the fourth course, but would normally be hidden from view by backfill.

Where appearance of the inside wall surfaces is an important consideration, however, such surfaces can also be made planar by employing modified right-circular cylindrical blocks 22 and 23 as illustrated in FIGS. 5*b* and 5*c*, respectively. Thus, the fourth course of blocks in FIG. 1 would comprise blocks 22, each including a notched end 21 that is positioned directly under the steps 50 of a pair of blocks 46 positioned thereabove. Corresponding to the blocks 51, the blocks 23 are provided with notched ends 21' that serve the same function as the notched ends 21 of the blocks 22. This serves to lock the course of blocks 46 to the fourth course of blocks 22 while maintaining the inside wall 10 surfaces planar.

In the interest of brevity, it will be understood, without further descriptive detail, that all of the various modular wall embodiments illustrated and described herein may be modified in the same or similar manner as described in the wall 10, particularly as regards the interchangeability of the blocks 22, 23 and 25.

Figure 3:
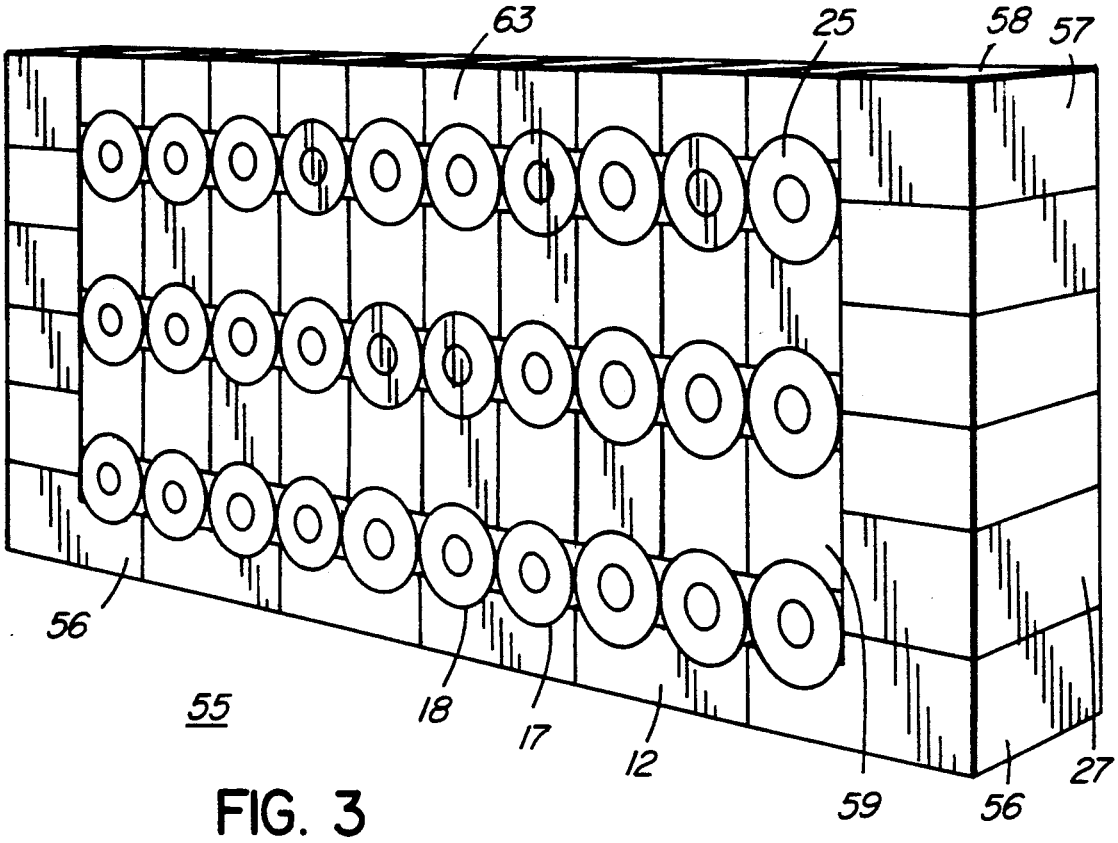
FIG. 3 is a perspective view of another embodiment of a modular wall in accordance with the invention.
Figure 15:
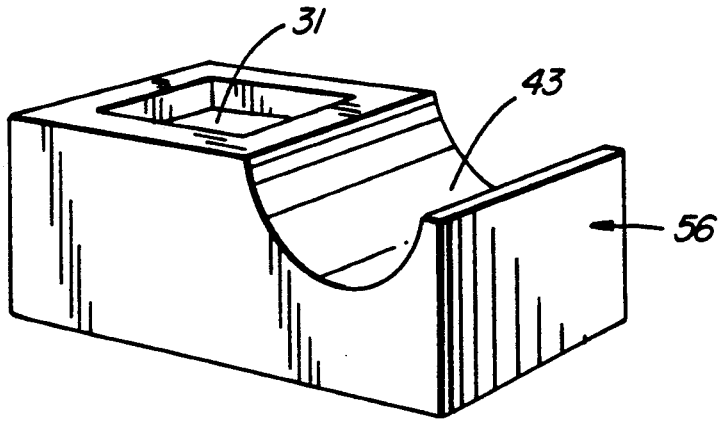
FIG. 15 is a perspective view of yet another base block.

FIG. 3 illustrates another embodiment of a modular wall which is shown as a complete straight wall 55. Similarities with the wall 10 may be seen in the foundation course which comprises blocks 12 supporting the first course of the blocks 25. Constraining means in each end of the foundation course include a modified corner base block shown as a corner base block 56 which appears in greater detail in FIG. 15. A comparison with FIG. 2 shows a similarity between blocks 26 and 56 wherein the block 56 includes the mortise 31 but only one semi-cylindrical channel 43 for lockably engaging one of the blocks 25.

The wall ends are symmetrical as illustrated in FIG. 3 and comprise four courses of blocks 27 which are capped with a modified corner block 57, the modification residing in the absence of a mortise 31. Instead, the block 57 includes a flat top surface 58.

Figure 11:
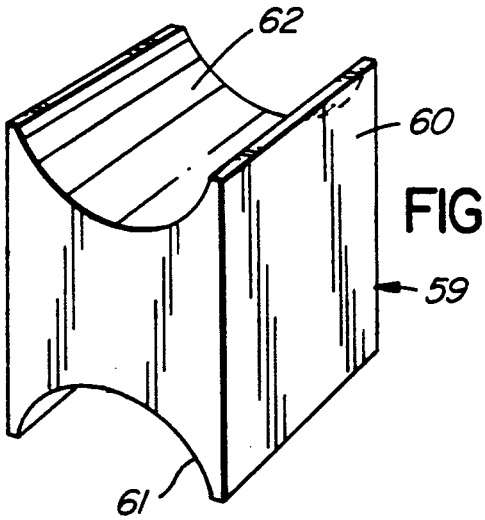
FIG. 11 is a perspective view of a spacer block shown in the embodiment of FIG. 3.

Intermediate the two interlocking columns of blocks 27, there is constrained alternate spacer and wall courses comprising, firstly, a course of spacer blocks 59 which are shown in greater detail in FIG. 11. Reference thereto shows that the block includes upstanding ends 60 that mutually contact like ends in adjacent blocks of the spacer course. A bottom surface includes a semi-cylindrical channel 61 that lockably engages a block 25 positioned directly thereunder. A like semi-cylindrical channel 62 is formed in a top surface and lockably engages a single block 25 positioned therein as illustrated in FIG. 3.

Figure 10:
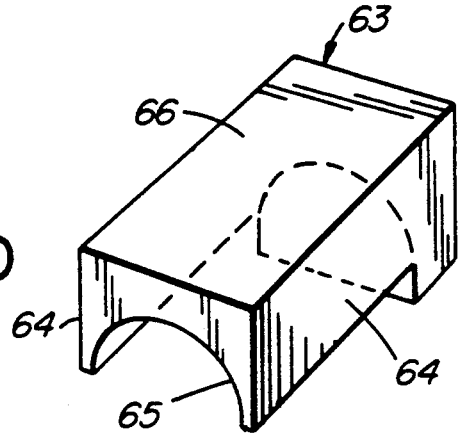
FIG. 10 is a perspective view of a cap and spacer block shown in the embodiment of FIG. 3.

A top course of cap and spacer blocks 63, FIG. 10, include upstanding ends 64 that mutually contact like ends in adjacent blocks. A bottom surface includes a semi-cylindrical channel 65 together with a depending step 50, like that shown in the block 46 (FIG. 6), for lockably engaging a block 25 that is positioned directly thereunder as illustrated in FIG. 3. Predetermined textured finishes are readily adapted in a top surface 66 which may be smooth, as illustrated, or textured to provide a non-slip surface.

Figure 4:
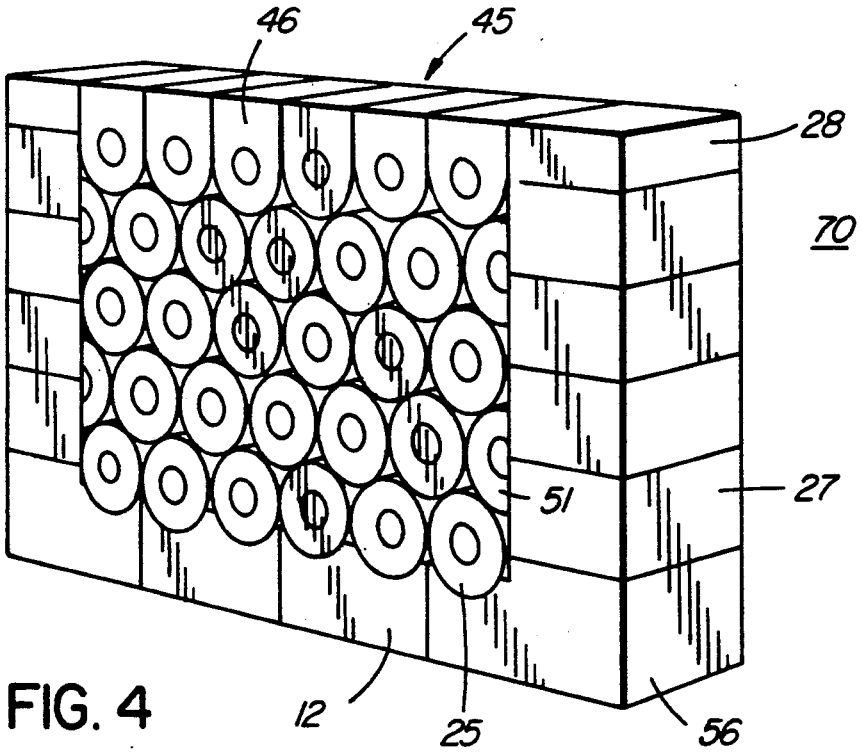
FIG. 4 is a perspective view of yet another embodiment of a modular wall in accordance with the invention.

Another example of a modular wall in accordance with the invention is shown as a complete straight wall 70, FIG. 4, assembled from the various blocks illustrated in FIGS. 1 and 3. A minor difference, however, will be observed in the opposing columns of blocks 27 which, in FIG. 4, are capped with the block 28, FIG. 14.

Although it is not shown in its entirety in any one of the modular walls heretofore described, FIG. 14 is illustrative of a base block 71 that is useful in supporting a column of blocks 27 intermediately placed along any one of the walls described herein. A similarity is apparent between the block 71 and block 26, FIG. 2, and block 56, FIG. 15. Essentially, the block 71 corresponds to the block 56 with the mortise 31 being centrally disposed between first and second top surface portions in which semi-cylindrical channels 67 and 68 are formed on opposite sides of the mortise 31.

Figure 8:
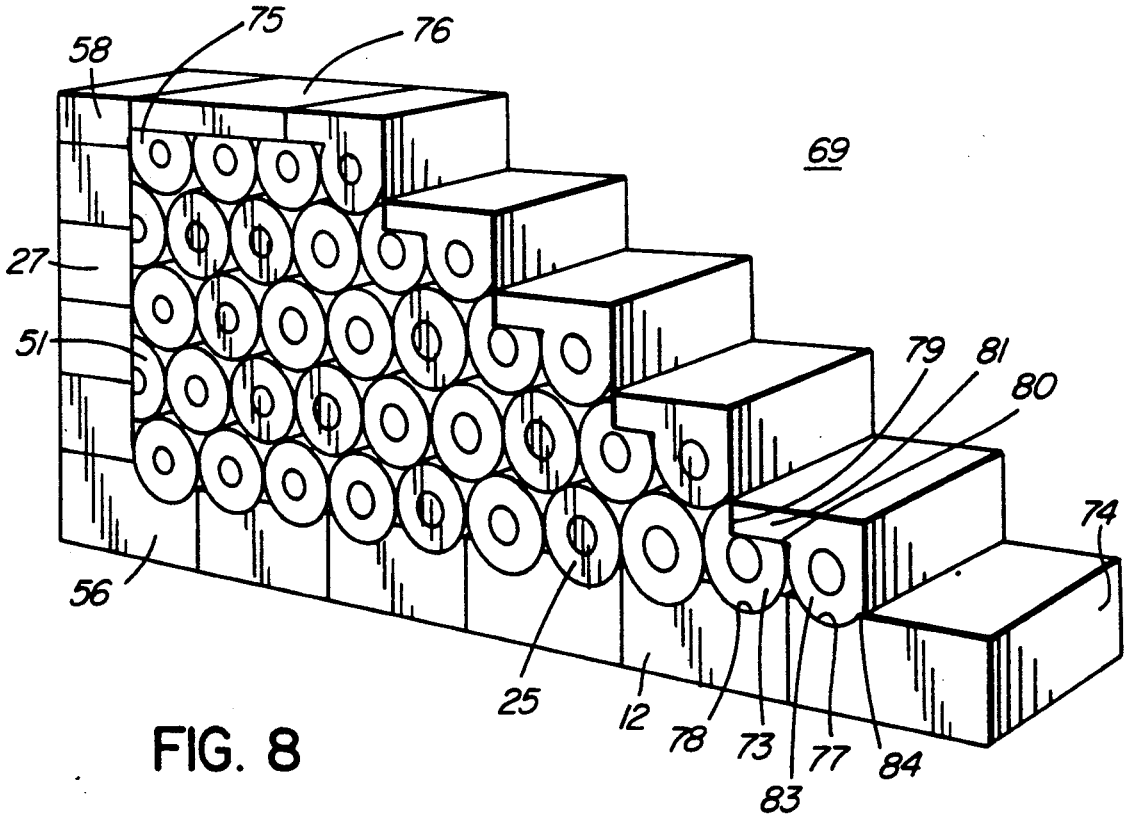
FIG. 8 is a perspective view of a buttress wall in accordance with the invention.

Similar in some respects to the modular wall heretofore described, another wall, known as a buttress wall 69 appears in FIG. 8. Similarities with the previously described walls may be seen in the use of blocks 12 and 56 in a foundation course together with blocks 27 and 58 comprising a column of interlocking corner blocks that serve as constraining means for the wall at one end thereof. As in the embodiment of the wall 70, the blocks 25 and 51 function as the principal components of the wall 69.

Figure 12:
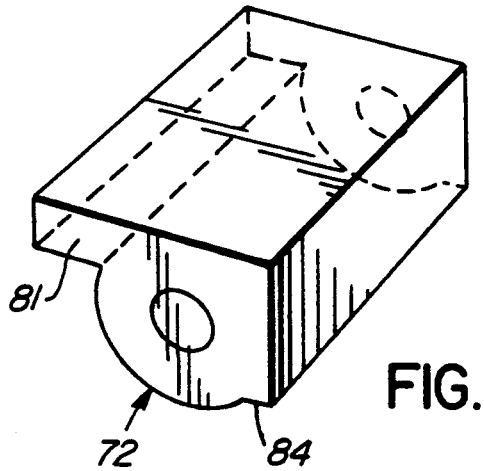
FIG. 12 is a perspective view of a step block shown in the embodiment of FIG. 8.
Figure 13:
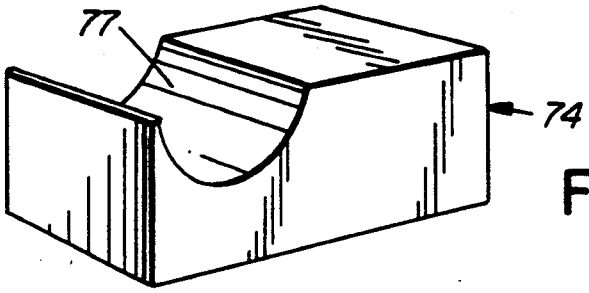
FIG. 13 is a perspective view of a base block shown in the embodiment of FIG. 8.
Figure 22:
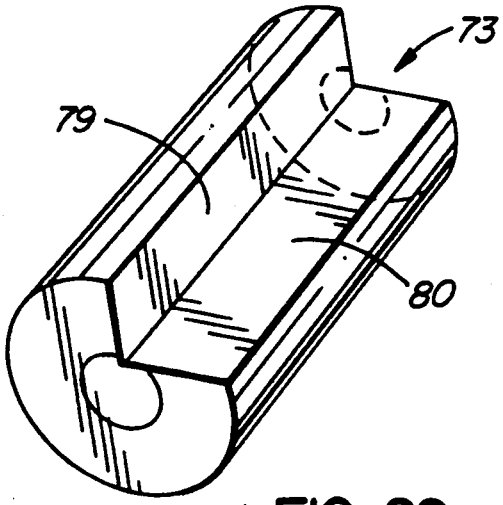
FIG. 22 is a perspective view of a stepped cylinder block shown in the embodiment of FIG. 20.

Distinguishing features in the wall 69 are apparent principally in a stepped configuration thereof that includes a plurality of step blocks 72, FIG. 12, together with supporting stepped cylinder blocks 73, FIG. 22, and a base block step 74, FIG. 13. Additional different structural features may be seen in a modified semi-cylindrical block 75, which is similar to the block 51, and a conventional slab 76.

Taking the block 56 as the originating block in the foundation course of the wall 69, it will be observed in FIG. 8 that the block 74 comprises an endmost base block that includes one semi-cylindrical channel 77 adjacent the last block 12. A single course of blocks 25 occupy corresponding channels in the blocks 12 and 56 with a semi-cylindrical channel frictionally engaging one of the blocks 73 as illustrated. It will be observed that the block 73 is oriented so that an upstanding riser 79 portion and a horizontal tread 80 portion provide support for a horizontal tread portion 81 of the block 72.

A corresponding horizontal tread surface of the block 72 is orthogonally positioned to the surface of a riser 82. Between these surfaces, a semi-cylindrical portion 83 frictionally engages the channel 77 in the block 74. A significant feature of the block 72 is the addition of a lip 84 which functions as a stop to prevent rotation of the block 72 in a first direction as, for example, when a heavy load is placed at the juncture of the surfaces corresponding to the tread 81 and the riser 82. As will be understood from the previous description of the block 73, rotation of the block 72 in the opposite direction is prevented through the support provided by the block 73. It will be understood that the lip 84 functions in the same manner in each succeeding block 72.

Figure 16:
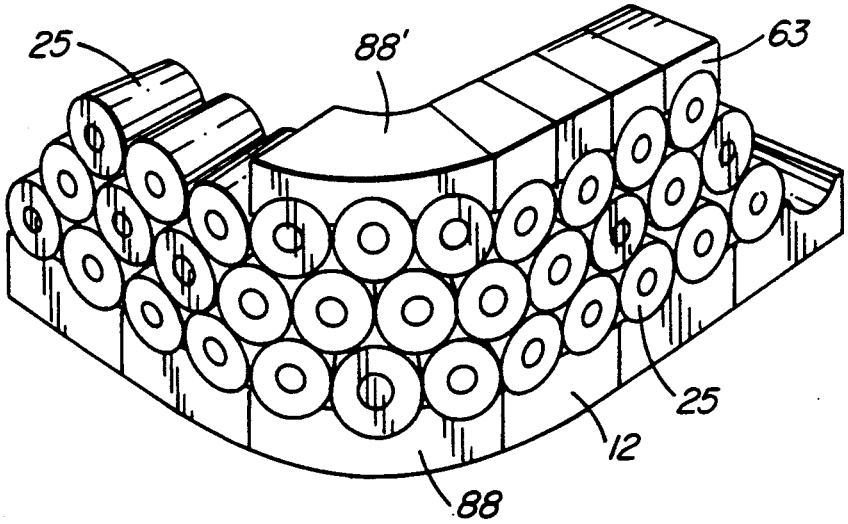
FIG. 16 is a perspective view of another embodiment of a modular wall according to the invention which includes a curved corner.
Figure 17:
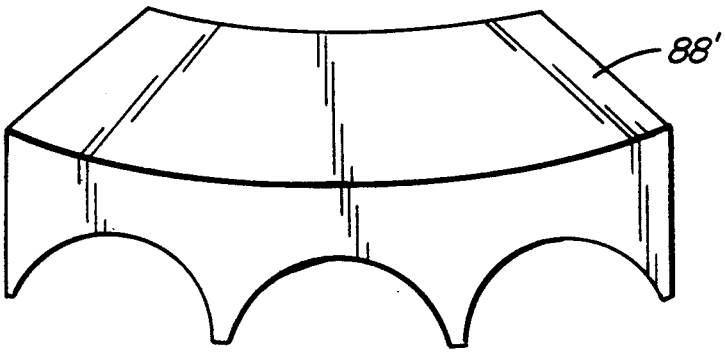
FIG. 17 is a perspective view of a top sectorial block shown in the embodiment of FIG. 16.
Figure 18:
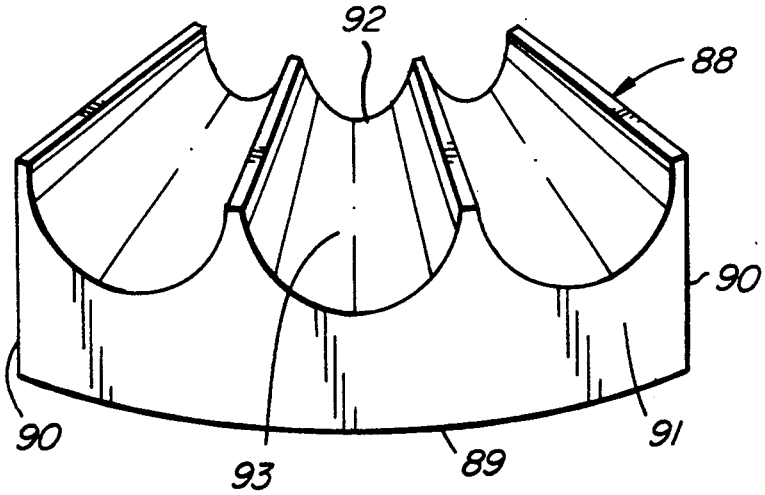
FIG. 18 is perspective view of a bottom sectorial block shown in the embodiment of FIG. 16.
Figure 19:
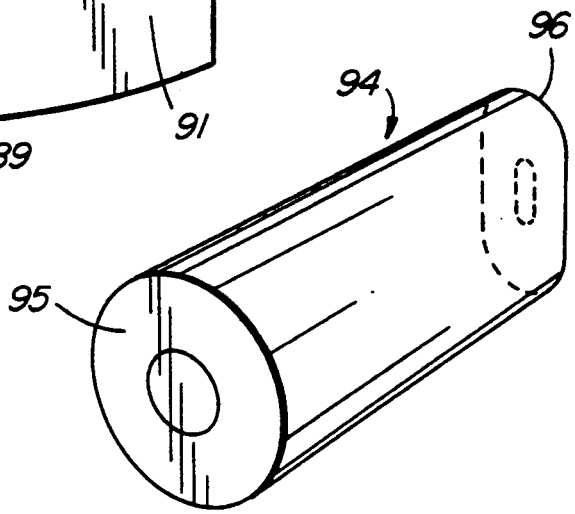
FIG. 19 is a perspective view of a tapered cylinder shown in the embodiment of FIG. 16.

Occasionally, a curved corner is required in a modular wall that is typified in a partial wall 87 illustrated in FIG. 16. It will be understood that up to the curved corner, the wall 87 is assembled from blocks 12, 25 and 63 of the type described in the wall 55. The curved corner is, however, unique in the wall 87, FIG. 16. Reference to FIGS. 17, 18 and 19 shows the various modules used in the curved corner of the wall 87. Thus, a sectorial block 88 functions as part of the foundation course and is provided with a flat base 89. The block 88 is further defined by upstanding rectilinear ends 90 that interface with corresponding ends of adjacent blocks 12 as may be seen in FIG. 16 and curvilinear sides 91 and 92 having different radii that depend upon the degree of curvature required. A top surface of the block 88 has formed therein three semi-cylindrical tapered channels 93 intermediate the sides 91 and 92, with extra channels 93 providing more curvature.

A top for the curved portion of the wall 87 is illustrated in FIG. 17 and comprises a second sectorial block 88' that corresponds to the block 88 but is disposed in inverted registry therewith as illustrated.

Tapered cylinders 94 of the form illustrated in FIG. 19 are adapted to fit the corresponding channels 93 and to be disposed in mutually contacting relation between corresponding adjacent pairs of tapered cylinders 94 in adjoining courses thereof as shown in the three courses of FIG. 16. Having regard to FIG. 19, it will be seen that each cylinder 94 includes a right-circular end 95 and an ellipsoidal end 96 which has a major radius substantially equal to that of the each 95 and at least one minor radius that is proportional to the smaller radius of the side 92, FIG. 18.

Figure 20:
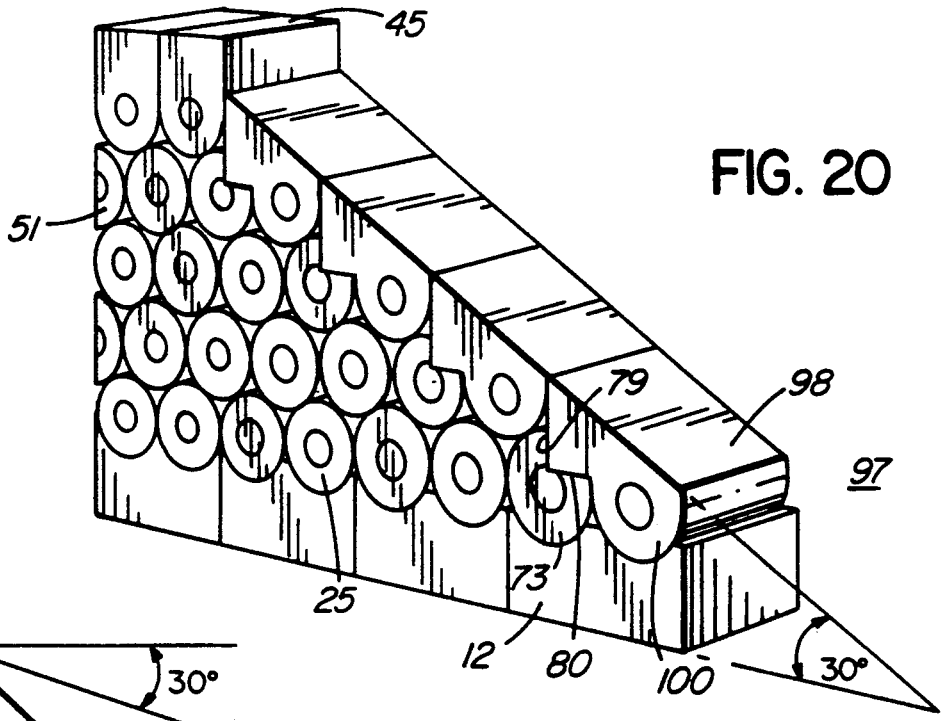
FIG. 20 is a perspective view of another buttress wall according to the invention.
Figure 21:
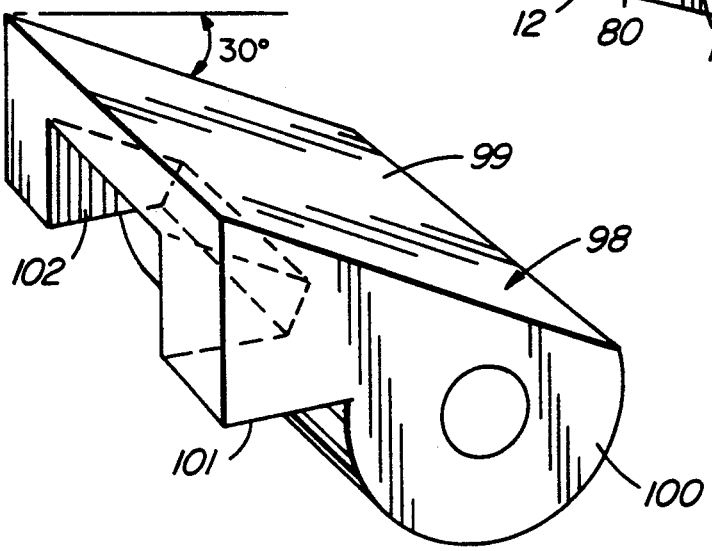
FIG. 21 is a perspective view of a coping block shown in the embodiment of FIG. 20.

Yet another form of modular wall in accordance with the invention appears in FIG. 20 as another buttress wall 97 comprising various modules in the form of different blocks heretofore described in the wall 10 for example. A distinction in the wall 97 occurs in a sloping portion thereof which is formed from a plurality of coping blocks 98 that are illustrated in greater detail in FIG. 21. Reference thereto shows that the block 98 includes a sloping upper surface 99, a semi-cylindrical portion 100 which is adjacent the low end of the surface 99 and an orthogonal corner 101 portion which is adjacent the upper end of the surface 99. This arrangement permits the portion 100 to frictionally engage a corresponding last channel in the endmost block 12 and the corner 101 portion to engage with and be supported by the riser 79 and tread 80 portions of the block 73. In the embodiment illustrated, the surface 99 is formed at an angle that is substantially 30 degrees relative the ground plane shown. It will be understood, however, that the surface 99 is not restricted to this angle and may be formed at other angles more suitable to the terrain at hand.

Formed centrally in the corner 101, a keyway 102 functions as a means to save weight by eliminating concrete in the block 98 and may also serve as a handhold to facilitate placement of the blocks.

Figure 24:
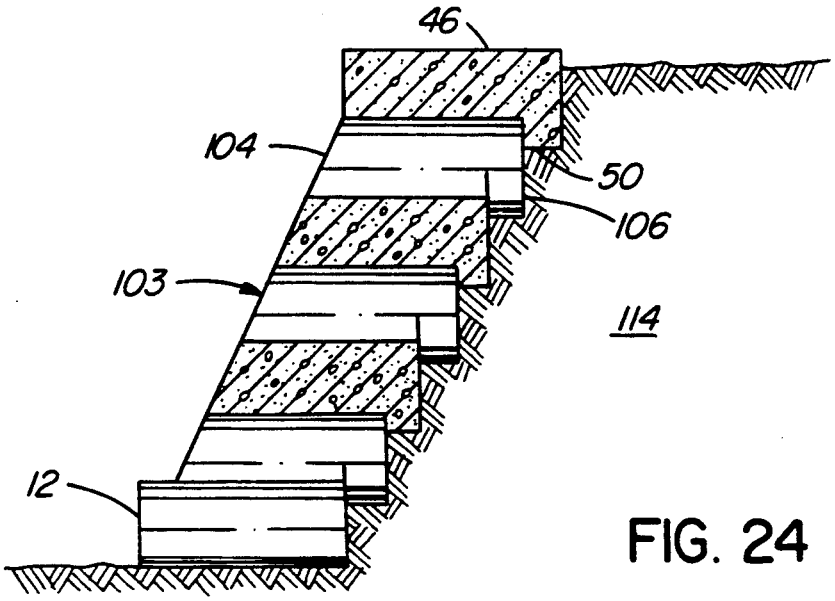
FIG. 24 is a cross-sectional view of an inclined retainer wall according to the invention.

FIG. 24 is a cross-sectional view illustrative of a sloping wall 114 assembled substantially from cylindrical wall blocks 103 having a sloping truncated end 104 and a right-circular end 105 from which a step 106 depends for engaging surface portions of the right-circular ends of the lower adjacent pair of wall blocks as will be understood from FIG. 24 and which is similar to that described for the block 46. With regard to FIG. 24, it will be observed that the step 106 functions to interlock all of the blocks 103 together with the base blocks 12. A similar interlocking action occurs with the blocks 46 by way of its depending step 50 as shown. In the arrangement illustrated, all of the truncated ends 104 lie substantially in a single plane that is disposed at an acute angle relative the plane of the right-circular and of each block 103.

Figure 26:
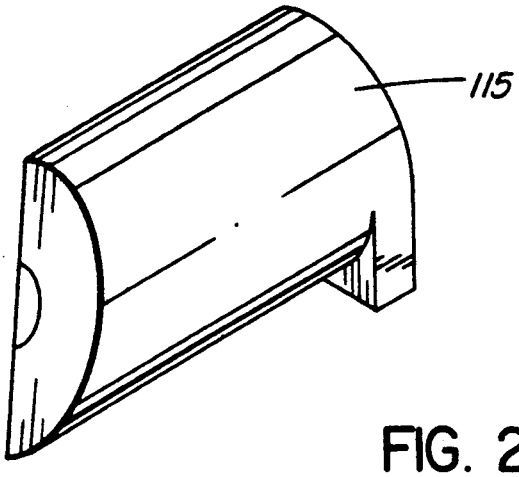
FIG. 26 is a perspective view of a block usable in the wall of FIG. 24.

Comparing the sloping wall 114 with the vertical wall 10 shows that a block equivalent to the block 51 may on occasion be required in the sloping wall. A block 115 having the attributes of the block 51 as well as the step 106 feature of the block 103 is shown in FIG. 26 as a block 103 split vertically along its central axis.

Moreover, the block 103 may be modified as a right-circular cylindrical wall block 24 having a depending step 106 as shown in FIG. **5*d*. In this configuration, the block 24 may be used to provide an interlocking feature in combination with blocks 22 similar to that described in the wall 10 for blocks 46**.

It will be understood that all of the blocks heretofore described are solid blocks preferably cast from a structural mix of portland concrete cement. In this regard, a coaxially positioned boss 116 on all blocks, such as on block 25, that are either circular or semi-circular in configuration, is merely present for ornamentation purposes.

Figure 25:
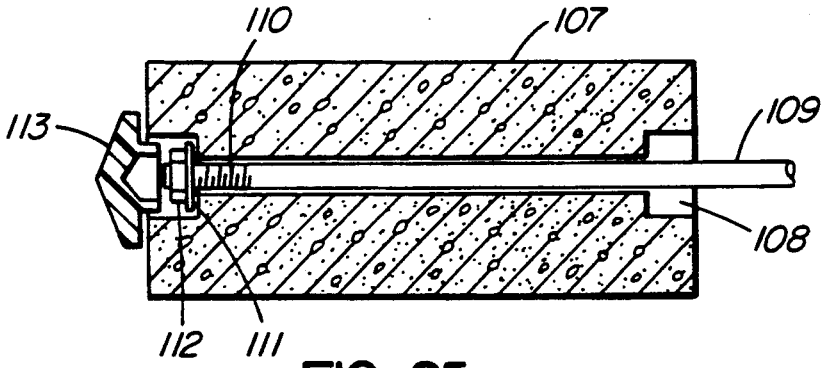
FIG. 25 is a cross-sectional view of a cylindrical wall block having a coaxial passageway therethrough.

Under certain conditions where it is required to anchor a retaining wall to an embankment, e.g., FIG. 24, or the like, a cylindrical block 107 having a coaxially disposed passageway 108 therethrough may be required. A cross-sectional view of the block 107 is illustrated in FIG. 25 and shows the passageway 108 with an anchor rod 109 portion leading therethrough. The anchored portion of the rod 109 is not illustrated and would be of a form that is well known to those skilled in the art. A free end of the rod 109 is threaded as at 110 to accept fastening means herein shown as a washer 111 and a threaded nut 112.

In order to protect the nut 112 and the thread 110 from the weather to reduce corrosion so as to effect easy subsequent removal of the block 107, an ornamental cap 113 is provided to engage sidewalls in the passageway 108 with a secure, weather-resistant interference fit.

Although the foregoing embodiments of the invention have been disclosed in some detail, it will be understood by those individuals skilled in the art to whom this specification is addressed that various changes may be made without departing from the true spirit and scope of the invention. For example, whereas the various structural blocks described are said to be solid in composition, such blocks may be substantially hollow. Moreover, although the drawings suggest that the various blocks described herein have smooth contacting surfaces, such surfaces may be textured or roughened in accordance with known methods to increase the coefficient of friction therebetween which will enhance the stability of the walls disclosed. Additionally, although various references have been made to semi-cylindrical blocks and channels, it will be understood that these structural elements need not be exactly one-half of a right-circular cylinder and that a partial semi-cylindrical shape may suffice to give effect to the invention disclosed and illustrated herein.

In other words, the direction of a semi-cylindrical block or channel is not necessarily a semi-circle but may be a portion thereof, or even a curve of any shape that satisfies the definition of a cylinder. One commonly accepted definition states that if the direction is a curve C in a plane and L is a line not in the plane, then the set of points on all lines which intersect C and are parallel to L is called a cylinder.

The embodiments of the invention in which an exclusive property or privilege is claimed are defined as follows:

1. A modular wall including a combination of interdependent modules arranged in stacked multiple courses, comprising:

a foundation course comprising a plurality of base blocks disposed in serial contacting relation, individual ones of the blocks including a flat base, upstanding ends, front and back sides and a top surface in which is formed at least one semi-cylindrical channel positioned transversely of the front and back sides; and a first wall course comprising a plurality of cylindrical wall blocks, individual ones of which engageably fit corresponding ones of the channels in the base blocks.

2. A modular wall as claimed in claim 1, further comprising constraining means disposed at respective ends of the foundation course for maintaining the mutually contacting relation of the base and wall blocks.

3. A modular wall as claimed in claim 2 wherein the constraining means at each end of the foundation course comprises a column of interlocking corner blocks mounted on a corresponding corner base block.

4. A modular wall as claimed in claim 3 wherein individual ones of the corner blocks comprise a base, top and upstanding sides, with the top further comprising a mortise potion, and the base further comprising a tenon portion lockably engaging the mortise portion of a lower adjacent block.

5. A modular wall as claimed in claim 4 wherein the corner base block comprises a base, top and upstanding sides with the top further comprising a mortise portion lockably engaging the tenon portion of a higher adjacent corner block and wherein a first top surface portion of the corner base block extends outwardly of the higher adjacent corner block in longitudinal alignment with the base blocks and includes one semi-cylindrical channel lockably engaging one of the wall blocks and retaining same in contacting relation with an adjacent wall block fitted to a corresponding base block.

6. A modular wall as claimed in claim 5, further comprising at least one second wall course corresponding to the first wall course and wherein the plurality of wall blocks are each positioned in mutually contacting relation between corresponding adjacent pairs of wall blocks in an adjoining course.

7. A modular wall as claimed in claim 6 further comprising:

a corner cap block mounted in registration with the uppermost corner block, the cap block having a base with a tenon portion extending therefrom lockably engaging the mortise portion of the uppermost corner block; and an edging course comprising a plurality of edge blocks, individual ones of which comprise a top surface having a predetermined finish, upstanding ends mutually contacting like ends in adjacent blocks of the edging course and a semi-cylindrical bottom surface mutually contacting corresponding adjacent pairs of wall blocks in the uppermost course thereof, said bottom surface further comprising a depending step engaging an end surface portion of each one of corresponding adjacent pairs of wall blocks for locking the individual ones of edge blocks to the wall.

8. A modular wall as claimed in claim 7, further comprising:

a spacer course comprising a plurality of spacer blocks, individual ones of which include upstanding ends mutually contacting like ends in adjacent blocks of the spacer course, a bottom having a semi-cylindrical channel lockably engaging a wall block positioned directly thereunder and a like semi-cylindrical channel in a top wall of the spacer block lockably engaging a wall block positioned therein.

9. A modular wall as claimed in claim 8 comprising alternate spacer and wall courses.

10. A modular wall as claimed in claim 9 further comprising a top course of cap and spacer blocks, individual ones of which include upstanding ends mutually contacting like ends in adjacent blocks of the top course, a bottom surface in which is formed a semi-cylindrical channel lockably engaging a wall block positioned directly thereunder and a top surface adapted to provide a predetermined textured finish.

11. A modular wall as claimed in claim 1, further comprising at least one second wall course corresponding to the first wall course wherein the plurality of wall blocks are each positioned in mutually contacting relation between corresponding adjacent pairs of wall blocks in an adjoining course and wherein each wall block includes a right-circular end disposed on one side of the wall and a frustum end disposed on the opposite side of the wall.

12. A modular wall as claimed in claim 11, further comprising a step depending from the right-circular end of each wall block for engaging surface portions of the right-circular ends of the corresponding adjacent pair of wall blocks, thereby interlocking the base and wall blocks to pre-empt slidable displacement therebetween when a pressing force is applied to the right-circular side of the wall.

13. A modular wall as claimed in claim 12 wherein the frustum end of each wall block lies substantially in a single plane disposed at an acute angle relative the plane of the right-circular end.

14. A modular wall as claimed in claim 13, further comprising an edging course including a plurality of edge blocks, individual ones of which comprise a top surface having a predetermined finish, upstanding ends mutually contacting like ends in adjacent blocks of the edging course and a semi-cylindrical bottom surface mutually contacting corresponding adjacent pairs of wall blocks in the uppermost course thereof, said bottom surface further comprising a depending step engaging an end surface portion of each one of the corresponding adjacent pairs of wall blocks for locking the individual ones of edge blocks to the wall.

15. A modular wall as claimed in claim 5 wherein the mortise portion of the corner base block is centrally disposed therein and the corner base block further comprises a second top surface portion in alignment with and corresponding to the first such portion on an opposite side of the mortise portion.

16. A modular wall as claimed in claim 5, wherein the corner base block comprises a second top surface portion corresponding to the first such portion and is disposed in orthogonal relation therewith within a common plane.

17. A modular wall as claimed in claim 2, wherein the constraining means at one end of the foundation course comprises:

a first sectorial block having a flat base, a first upstanding rectilinear end adjacent the foundation course, a second upstanding rectilinear end, a pair of curvilinear sides with different radii and a top surface having at least two semi-cylindrical tapered channels formed therein between the curvilinear sides;

a second sectorial block corresponding to the first such block and disposed in inverted registry therewith to form a top for the constraining means; and a plurality of tapered cylinders adapted to fit corresponding tapered channels in the sectorial blocks and to be disposed in mutually contacting relation between corresponding adjacent pairs of tapered cylinders in adjoining courses thereof.

18. A modular wall as claimed in claim 17 wherein each tapered cylinder includes a right-circular end and an ellipsoidal end having a major radius substantially equal to that of the right-circular end and at least one minor radius proportional to the small radius of the sectorial block.

19. A modular wall as claimed in claim 1, wherein an endmost base block includes two semi-cylindrical channels, the modular wall further comprising:

at least one second wall course corresponding to the first wall course and wherein the plurality of wall blocks are each positioned in mutually contacting relation between corresponding pairs of wall blocks in an adjoining course;

a first stepped cylinder frictionally engaging the penultimate channel in the endmost base block, the stepped cylinder having an upstanding riser portion and a horizontal tread portion; and a first coping block having a sloping upper surface, a semi-cylindrical portion adjacent the low end of the sloping surface frictionally engaging the last channel in the endmost base block, and an orthogonal corner portion adjacent the upper end of the sloping surface engaging with and supported by the riser and tread portions of the stepped cylinder.

20. A modular wall as claimed in claim 19, further comprising:

a second stepped cylinder corresponding to the first such cylinder and disposed in mutually contacting relation between a pair of wall blocks engageably fitting corresponding channels in the penultimate base block; and a second coping block corresponding to the first such block with the semi-cylindrical portion of the second coping block disposed in mutually contacting relation between the first stepped cylinder and the preceding wall block in the penultimate base block, and the orthogonal corner portion of the second coping block engaging with and supported by the riser and tread portions of the second stepped cylinder.

21. A modular wall as claimed in claim 1 wherein an endmost base block includes one semi-cylindrical channel adjacent one end of the block opposite a free end thereof, the modular wall further comprising:

at least one second wall course corresponding to the first wall course and wherein the plurality of wall blocks are each positioned in mutually contacting relation between corresponding pairs of wall blocks in an adjoining course;

a first stepped cylinder frictionally engaging the penultimate channel of the endmost and penultimate base blocks, the stepped cylinder having an upstanding riser portion and a horizontal tread portion; and a first step block having a horizontal tread surface with a free end thereof supported by the riser and tread portions of the first stepped cylinder, an orthogonal riser surface, a semi-cylindrical portion disposed between the tread and riser surfaces and inwardly of the latter to form a lip between the semi-cylindrical portion and the riser surface, the semi-cylindrical portion frictionally engaging the channel in the endmost base block and being prevented from rotating in a first direction by means of the lip and in the opposite direction by means of the supporting first stepped cylinder.

22. A modular wall as claimed in claim 21, further comprising:

a second stepped cylinder corresponding to the first such cylinder and disposed in mutually contacting relation between a pair of wall blocks engageably fitting corresponding channels in the penultimate base block and the base block adjacent thereto; and a second step block corresponding to the first such block with the semi-cylindrical portion of the second step block disposed in mutually contacting relation between the first stepped cylinder and a preceding wall block in the penultimate base block, and the free end of the horizontal tread surface of the second step block engaging with and supported by the riser and tread portions of the second stepped cylinder.

23. A modular wall as claimed in claim 9 wherein predetermined ones of the wall blocks include a coaxially disposed passageway therethrough, the modular wall further comprising:

anchor means adapted to be securely embedded in an embankment adjacent the wall;

rod means having one end attached to the embedded anchor means and an opposite free end extending through each passageway of the predetermined ones of wall blocks;

fastener means connecting the free end to its wall block; and cap means adapted to protectively cover the passageway at the fastener means.

24. A modular wall as claimed in claim 23 wherein all of the blocks are cast from a structural mix of portland concrete cement.

* * * * *